US008624510B2

(12) United States Patent
Raykhman et al.

(10) Patent No.: US 8,624,510 B2
(45) Date of Patent: Jan. 7, 2014

(54) CONTROL CIRCUIT FOR LIGHT EMITTING DIODE ARRANGEMENTS

(75) Inventors: Mykhaylo Raykhman, Munich (DE); Manfred Schlenk, Augsburg (DE); Hans Hoffmann, Augsburg (DE)

(73) Assignee: Minebea Co., Ltd., Nagano-ken (JP)

( * ) Notice: Subject to any disclaimer, the term of this patent is extended or adjusted under 35 U.S.C. 154(b) by 113 days.

(21) Appl. No.: 13/372,644

(22) Filed: Feb. 14, 2012

(65) Prior Publication Data

US 2012/0217884 A1 Aug. 30, 2012

(30) Foreign Application Priority Data

Feb. 28, 2011 (DE) ..... 10 2011 012 636

(51) Int. Cl.
*H05B 37/00* (2006.01)
*H05B 39/00* (2006.01)
*H05B 41/00* (2006.01)

(52) U.S. Cl.
USPC ..... 315/188; 315/192; 315/193; 315/282; 315/299

(58) Field of Classification Search
None
See application file for complete search history.

(56) References Cited

U.S. PATENT DOCUMENTS

| | | | | |
|---|---|---|---|---|
| 2006/0284569 | A1 | 12/2006 | Wey et al. | |
| 2010/0195024 | A1 | 8/2010 | Yoo et al. | |
| 2010/0237799 | A1 | 9/2010 | Choi et al. | |
| 2012/0062147 | A1 * | 3/2012 | Fan | 315/297 |
| 2012/0146546 | A1 * | 6/2012 | Hu et al. | 315/297 |

FOREIGN PATENT DOCUMENTS

| | | |
|---|---|---|
| DE | 10243794 | 3/2007 |
| DE | 102010020483 | 11/2011 |
| EP | 2306786 | 4/2011 |
| WO | 2010137921 | 12/2010 |

* cited by examiner

*Primary Examiner* — Anh Tran
(74) *Attorney, Agent, or Firm* — Volpe and Koenig, P.C.

(57) ABSTRACT

A control circuit (1) for light emitting diode arrangements (11), used particularly for backlighting LC flat screens. The circuit has a plurality of control channels (5, 5') in each of which one or more light emitting diode arrangements (11) are disposed. The circuit has a balancing device (23) which allows currents in the individual control channels (5, 5') to be balanced. Each control channel (5, 5') has a separate dimming device (13) through which a brightness of the light emitting diode arrangements (11) in this control channel (5, 5') can be changed separately from the other control channels (5, 5'). For this purpose, the control circuit has a compensation device (16) which allows a flow of current in the individual control channels (5, 5') to be balanced when the light emitting diodes have different brightnesses.

10 Claims, 5 Drawing Sheets

CONTROL CIRCUIT FOR LIGHT EMITTING DIODE ARRANGEMENTS

CROSS-REFERENCE TO RELATED APPLICATIONS

This application claims the benefit of German Patent Application No. 10 2011 012 636.8, filed Feb. 28, 2011, which is incorporated herein by reference as if fully set forth.

BACKGROUND

The invention provides a control circuit for light emitting diode arrangements, having at least two circuit branches for at least one light emitting diode arrangement and having a balancing device for balancing the currents in the individual circuit branches.

These kinds of control circuits find application, for example, in modern flat-screen televisions having an LCD display in order to control the required backlighting. At the edges of the screen, for example, a plurality of light emitting diode arrangements having light emitting diode strings for example, are thereby disposed, which, using suitable diffusion disks, illuminate the entire screen. Here, the light emitting diode arrangements are separately controlled in separate control channels so as to keep the required voltages low.

An important aspect of high-quality in these kinds of televisions is uniform illumination over the entire surface of the screen. That is why the control circuit has a balancing device, such as a transformer arrangement, to balance the currents in the individual control channels. In this way, the current that flows through each light emitting diode is balanced, thus making the brightness of all light emitting diodes mostly identical as well.

In the prior art, various transformer arrangements of this kind are known and the person skilled in the art will be able to choose a suitable arrangement from this selection. A large number of active balancing circuits that do not need a transformer are also known from the prior art, these, however, are more complex and more expensive.

Furthermore, it is normal for the brightness of the backlight to be adjustable, making the image adaptable to different environments. For this purpose, the control circuit has a dimming device allowing the overall brightness to be changed. This is usually effected through a change in voltage on the primary side of the transformer arrangement.

This kind of control circuit is known, for example, from US 2010/0237799 A1 and is shown in FIG. 1 by way of example. The control circuit has a mains connection 26, an input filter 24, a power factor correction circuit 2 and an inverter 3. In the example, the circuit has N control channels 5 of which three are illustrated. A balancing transformer 8 is disposed in each control channel 5, the primary windings 12 being connected in series to the inverter 3. On the secondary side of the transformers 8, each control channel 5 has a secondary winding 7, a bridge rectifier 9, smoothing capacitors Cp 10 and a light emitting diode arrangement 11 each having two light emitting diodes 25 that are connected in a well-known manner.

If, in the illustrated circuit, a light emitting diode or a light emitting diode string should fail due to a defect, the current in this control channel drops to zero. As a result, the balancing of currents is impaired, which is why the entire circuit can no longer be operated. This is also why it is only possible to dim all the control channels jointly over the primary side, otherwise currents of varying intensity would also flow in the individual control channels.

Moreover, the control circuit has long current rise and current fall times (>50 μs) during dimming, which is due to the leakage inductance of the transformers and the capacitance of the smoothing capacitors.

SUMMARY

The object of the invention is thus to create a control circuit of the kind mentioned above that does not have the disadvantages as described.

This object has been achieved according to the invention in that the control circuit has at least one control channel and a total of at least two circuit branches, that at least one circuit branch having a light emitting diode arrangement is associated with each control channel and that at least some of the circuit branches have compensation means so that the currents in the individual circuit branches are substantially the same even when brightnesses differ.

This has the advantage that even in the case of total failure or a defect in a light emitting diode arrangement, the circuit continues to be functional and the remaining undamaged light emitting diode arrangements can continue to be operated.

Moreover, each control channel preferably has a dimming device which allows the brightness of the associated light emitting diode arrangement to be changed independently of the other control channels and the control channels have compensation means so that the currents in the individual control channels are substantially the same even when brightnesses differ.

Each control channel now has its own, separate dimming device which allows the control channels to be dimmed separately. When the brightness changes, however, the current within the control channel also changes. This is contradictory to current balancing, which balances the currents in all control channels.

The compensation means between the control channels and/or circuit branches make it possible for the currents in the individual control channels to be substantially balanced even when the light emitting diode arrangements have different brightnesses. In this kind of control circuit, the balancing transformers may have lower leakage inductance which allows the current rise and current fall times during dimming to be considerably reduced, for example below 1 μs.

To realize the compensation means in a preferred embodiment of the invention, two control channels or circuit branches are connected together in pairs using a double Zener diode. The double Zener diodes consist of two Zener diodes that are connected in series and connected together at their anodes.

When all the control channels are operated at full brightness, no current flows through the Zener diodes. Due to current balancing, the current in all control channels is the same.

If the brightness in a control channel changes in comparison to another control channel connected to it via the Zener diodes, a difference in potential is produced between the control channels that results in a flow of current through the Zener diodes. The overall current through the control channels thus remains the same in all control channels.

Absolute reliability against the failure of several light emitting diode arrangements can be achieved in that, as a means of compensation, all circuit branches are interconnected with one another using a double Zener diode.

In principle, it is beneficial if each control channel has exactly one circuit branch with exactly one light emitting diode arrangement, although other configurations are certainly conceivable.

It is also possible, for example, to combine several circuit branches in one control channel, so that there are several light emitting diode arrangements in one control channel. Here, the individual circuit branches can be jointly dimmed with the dimming device of the control channel.

As a dimming device, it is preferable if in each control channel, a FET switch is disposed between the light emitting diode arrangement or the smoothing capacitor and ground and the gate inputs of the FET switches are connected together with a dimming control signal. The dimming control can, for example, be realized through pulse width modulation. However, other dimming devices and dimming controls are also conceivable.

It is beneficial if each circuit branch has a bridge rectifier that has four diodes and a smoothing capacitor. Any other kind of rectifier may also basically be used.

It is useful if the light emitting diode arrangements have a light emitting diode string consisting of at least one light emitting diode. It is particularly beneficial if the light emitting diode arrangement has several light emitting diodes connected in parallel or preferably in series. The number of light emitting diodes may vary between the individual light emitting diode arrangements, although it is advantageous for current balancing if all the light emitting diode arrangements are substantially identical.

In an advantageous embodiment of the invention, the control circuit has, as its dimming device, a transformer arrangement. Here, a transformer having a transformer core is provided for each circuit branch, the primary windings of all circuit branches being connected in series and the secondary windings being connected to the rectifiers. This passive balancing device makes possible a simple, low-cost construction for the control circuit in which the efficiency is very high. Other balancing devices may, of course, also be provided, particularly active circuits.

It is beneficial if the primary windings are connected to the alternating current output of an inverter circuit that generates a high-frequency AC voltage. Other AC voltage sources may of course be provided as well.

BRIEF DESCRIPTION OF THE DRAWINGS

The invention is described in more detail below on the basis of various embodiments with reference to the attached drawings.

The drawings show.

DETAILED DESCRIPTION OF THE PREFERRED EMBODIMENTS

Figure 1:
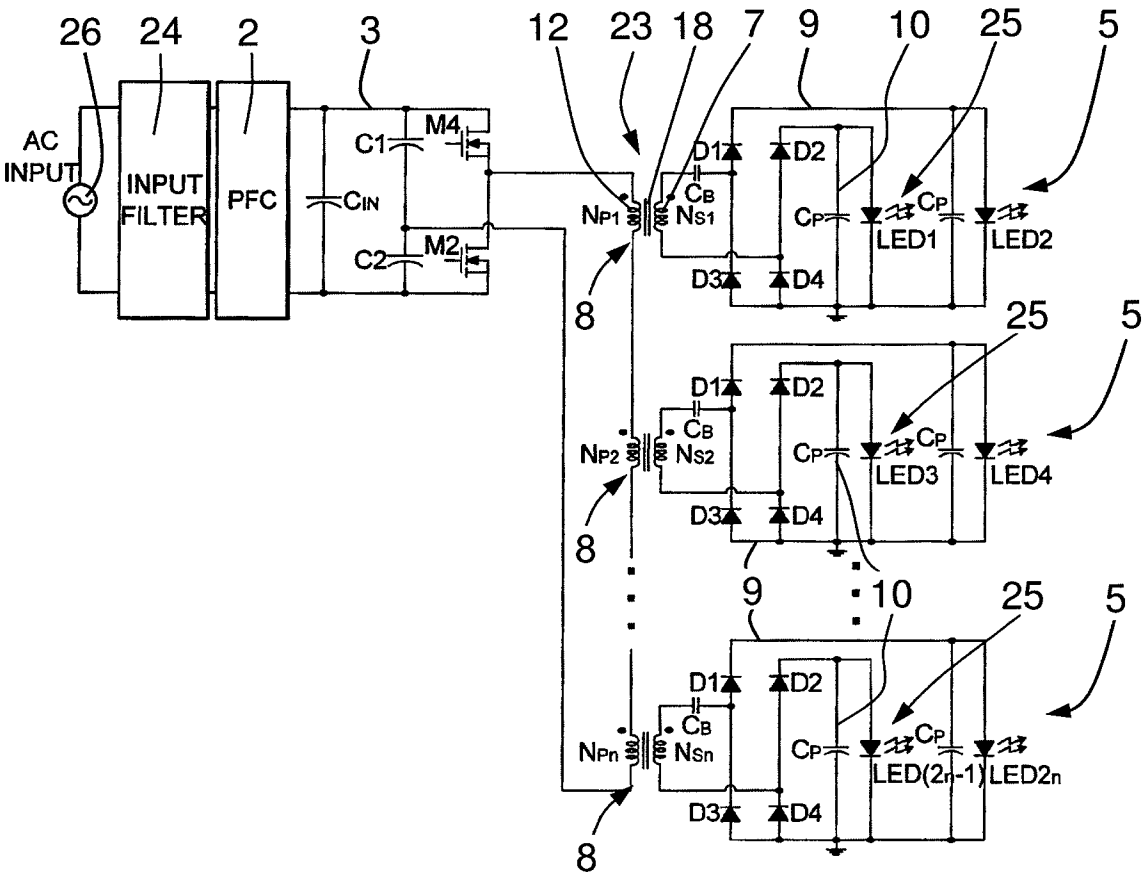
Fig. 1 Prior Art
FIG. 1 a control circuit according to the prior art.
Figure 2:
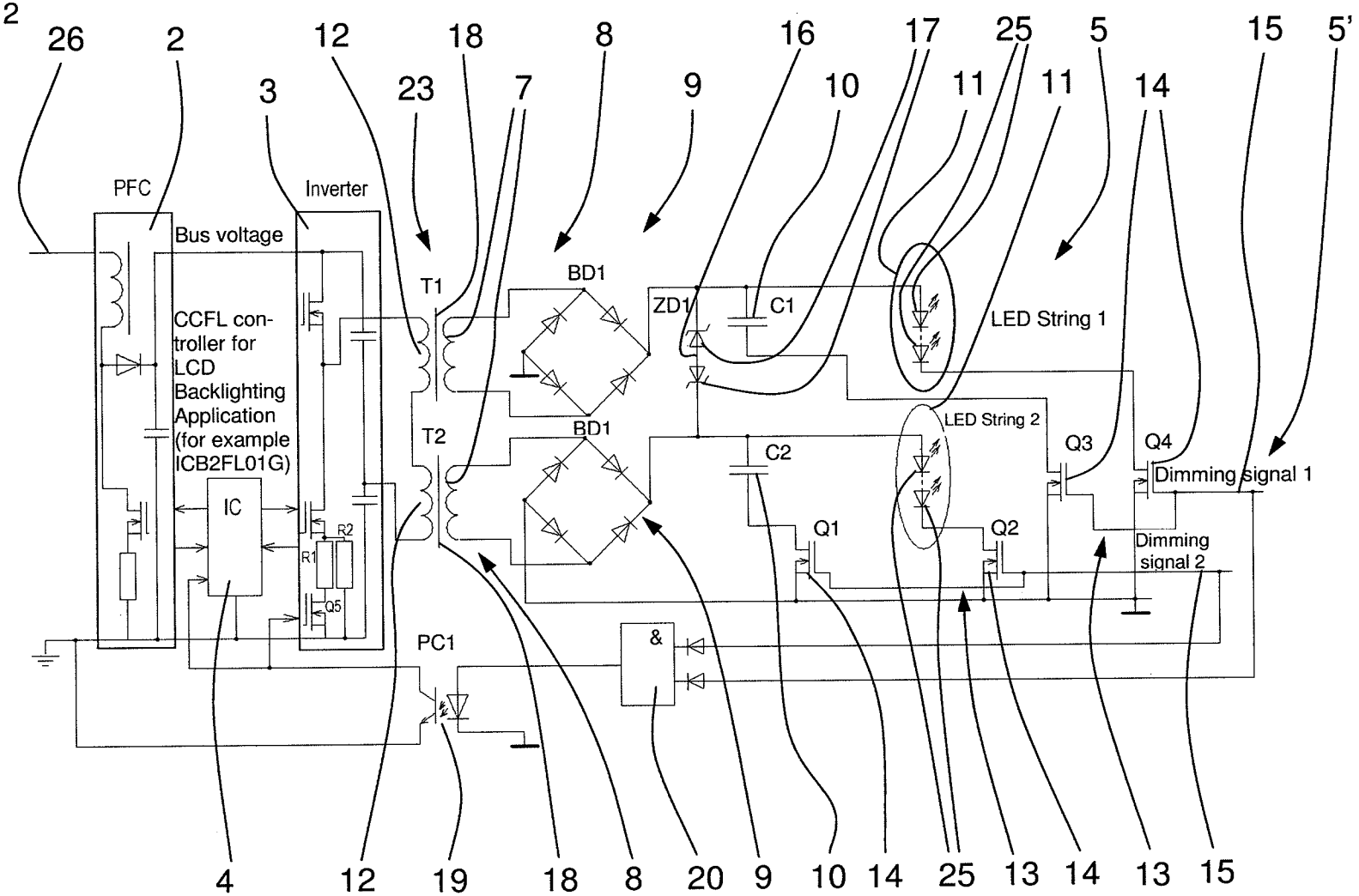
FIG. 2 a control circuit according to the invention having two control channels each having one circuit branch, FIG. 3 a control circuit according to the invention having two control channels each having two circuit branches, FIG. 4 a control circuit according to the invention having two control channels each having two circuit branches and enhanced safeguards against failure, and FIG. 5 a control circuit according to the invention having one control channel and three circuit branches.

FIG. 2 now shows a first embodiment of a control circuit 1 according to the invention. The circuit 1 also has a power factor correction circuit 2, an inverter 3 and a control component 4. The inverter 3 has at least one current-sensing resistor R1 that is connected to the control component.

The power factor correction circuit 2 and the inverter 3 are both well-known assemblies, so that no further details relating to them are given here. In practice, these assemblies come in a variety of designs, what, however, is not relevant for the invention.

In the illustrated embodiment, the control circuit 1 has two control channels 5, 5'. Each control channel 5, 5' has a circuit branch 6. As a balancing device, the circuit has a transformer arrangement in which a balancing transformer 8 having a transformer core 18 is disposed in each circuit branch.

The secondary winding 7 of a balancing transformer 8, a bridge rectifier 9, a smoothing capacitor 10 and a light emitting diode string 11 is disposed in each circuit branch 6. In each light emitting diode string 11, one or more light emitting diodes 25—here two—are connected in series.

The primary windings 12 of the two balancing transformers 8 are connected in series to the AC voltage output of the inverter 3. Here, a simple, passive transformer arrangement has been chosen as a balancing device 23 since it is inexpensive and has excellent efficiency. Other balancing devices, particularly active circuits, may, of course, also be used.

According to the invention, each control channel 5, 5' now has its own dimming device 13. In the example, this device consists of two FET switches 14, via which the smoothing capacitor 10 and the light emitting diode string 11 are connected to ground. Both FET switches 14 are connected to a dimming signal 15.

The dimming signal 15 is a pulsed square wave signal that switches the two switches 14 on and off. Changing the duty cycle of the dimming signal 15 thus makes it possible to change the brightness of the respective light emitting diode string 11.

The pulsed control of the light emitting diode string 11 means that no current flows in the control channel 5 during the off-times. To prevent current control and current balancing from failing in these off-times, there is a means of compensation 16, which, in the example, takes the form of a double Zener diode. The double Zener diode consists of two Zener diodes 17 connected in series that are connected together at their anodes. The cathodes of the double Zener diode 16 are connected to the positive output of the bridge rectifier 9 in the two control channels 5.

The separate dimming signals 15 of the two control channels are additionally connected to the control component 4 and the inverter 3 via a logical AND operation 20 and galvanically isolated via an optocoupler 19.

Figure 3:
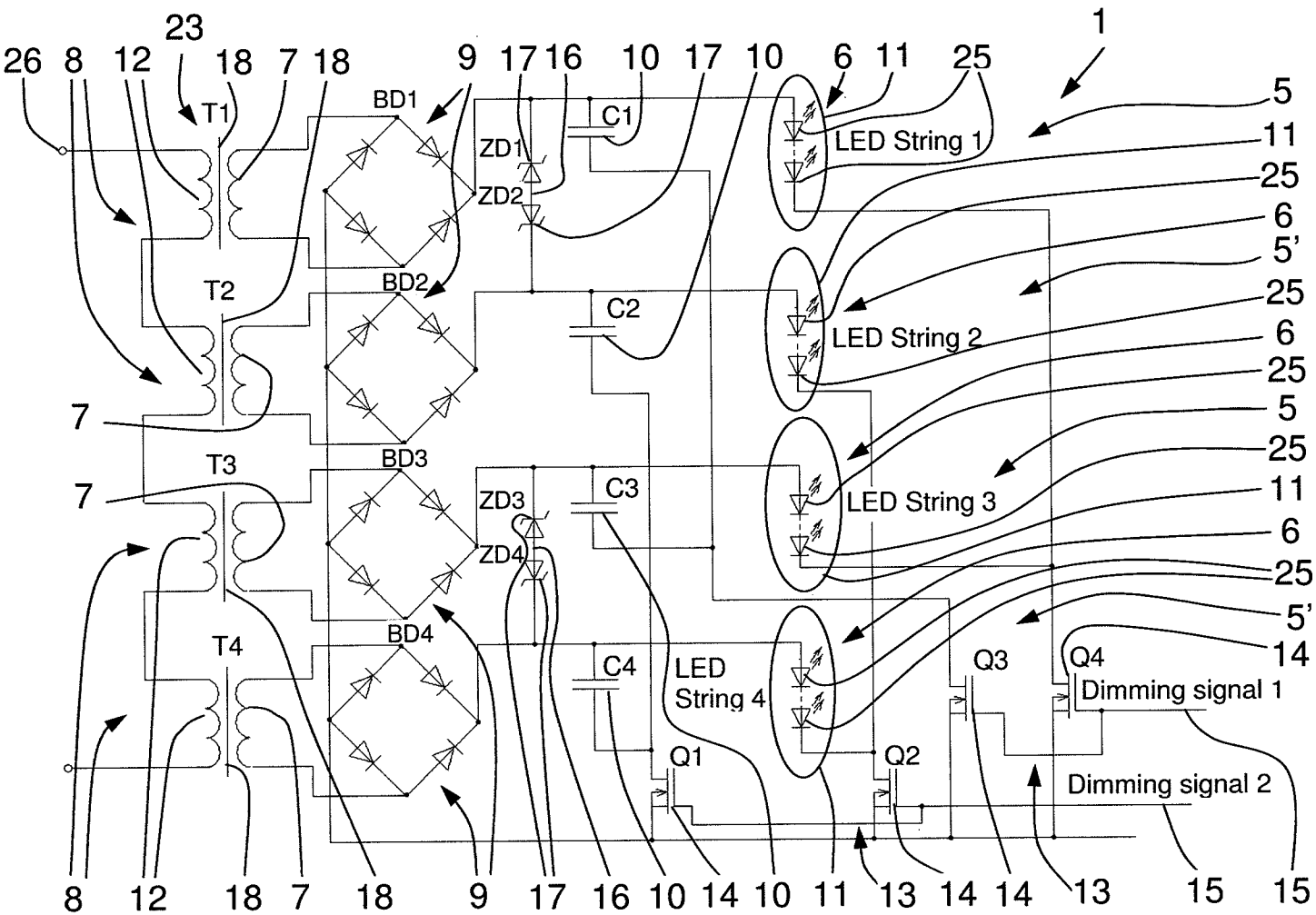

FIG. 3 shows a similar circuit to that in FIG. 2, the balancing device 23 and the control channels 5 being illustrated here.

Here, each control channel 5, 5' has two circuit branches 6 that can be jointly controlled via the dimming device 13 of the control channel 5, 5'. The double Zener diodes 16 are disposed here between the first circuit branch 6 of the first control channel 5 and the first circuit branch 6 of the second control channel 5' and between the second circuit branch 6 of the first control channel 5 and the second circuit branch 6 of the second control channel 5'.

Figure 4:
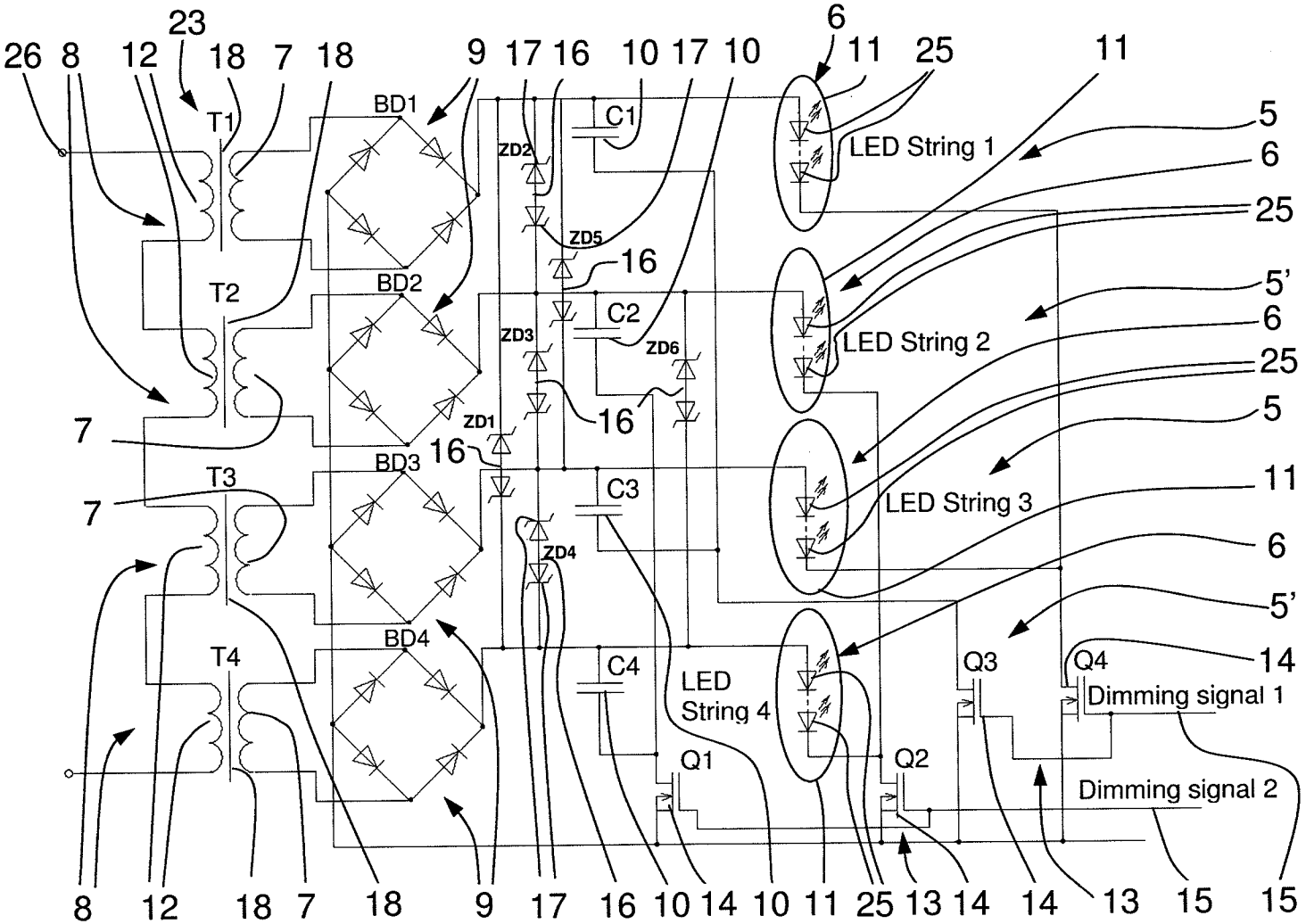

The circuit according to FIG. 4 corresponds substantially to the circuit of FIG. 3. As an additional safeguard against failure, here the first circuit branch 6 of the first control channel 5 is additionally connected to the second circuit branch 6 of the second control channel 5', the second circuit branch of the first control channel 5 is connected to the first circuit branch of the second control channel 5', the first circuit branch of the first control channel 5 is connected to the second circuit branch of the first control channel 5 and the first circuit branch of the second control channel 5' is connected to the second circuit branch of the second control channel 5' using double Zener diodes 16.

The functionality according to the invention is based on the combination of the means of compensation and the separate dimming devices, which allow the individual control channels to be separately dimmed. The remaining parts of the circuit are more or less arbitrary so that the type of high-frequency voltage supply, the type of rectifier and the type of current balancing do not play a part in the functionality of the invention, although all these components or assemblies are necessary. Depending on the application and cost considerations, the skilled person will be able to find suitable components for this purpose. The invention is thus in no way limited to the embodiments illustrated here.

Figure 5:
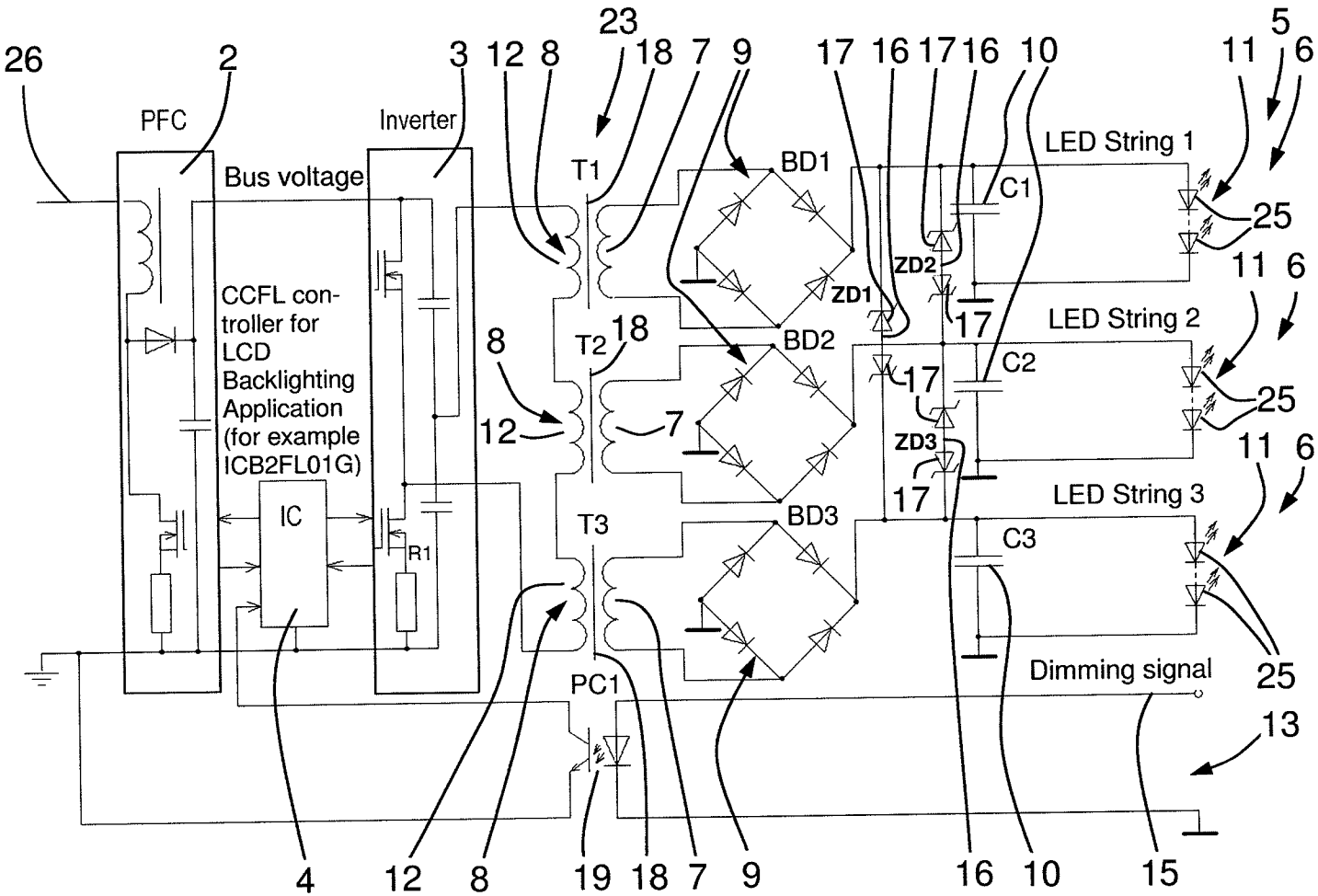

A special embodiment of the invention having only one control channel 5 is illustrated in FIG. 5. The single control channel 5, however, has three circuit branches 6. The dimming device 13 of the control channel 5 is connected via an optocoupler 19 to the control component 4 of the power supply, thus acting on the primary side, which, however, is not excluded by the invention. The important thing is that the circuit branches are connected through means of compensation 16, which here again take the form of double Zener diodes. Here, all three circuit branches are connected together using such double Zener diodes 16 to fully safeguard against failure.

IDENTIFICATION REFERENCE LIST

1 Control circuit
2 Power factor correction circuit
3 Inverter
4 Control component
5, 5' Control channel
6 Circuit branch
7 Secondary winding
8 Balancing transformer
9 Bridge rectifier
10 Smoothing capacitor
11 Light emitting diode string
12 Primary winding
13 Dimming device
14 FET switch
15 Dimming signal
16 Compensation means
17 Zener diode
18 Transformer core
19 Optocoupler
20 Logical AND operation
22 Sensing resistor
23 Balancing device
24 Input filter
25 Light emitting diode
26 Mains connection
R1 Current-sensing resistor

The invention claimed is:

1. A control circuit for light emitting diode arrangements (11), comprising at least two circuit branches (6), each for at least one light emitting diode arrangement (11) and having a balancing device (8) for balancing currents in the individual circuit branches (6), a control circuit has at least one control channel (5, 5'), at least one of the circuit branches (6) having the light emitting diode arrangement (11) is associated with each of the control channel (5, 5'), and at least some of the circuit branches (6) have compensation means (16) so that the currents in the individual circuit branches (6) are substantially the same even if the light emitting diodes have different brightnesses.

2. A control circuit according to claim 1, wherein as compensation means, two of the circuit branches (6) are connected together in pairs using a double Zener diode (16).

3. A control circuit according to claim 1, wherein each of the control channels (5, 5') has a dimming device (13) which allows a brightness of the associated light emitting diode arrangement (11) to be changed independently of the other control channels (5, 5').

4. A control circuit according to claim 1, wherein each of the control channels (5, 5') has at least of the two circuit branches (6).

5. A control circuit according to claim 1, wherein each of the control channels (5) has exactly one of the circuit branches (6).

6. A control circuit according to claim 1, wherein each of the circuit branches (6) has a bridge rectifier (9) and a smoothing capacitor (10).

7. A control circuit according to claim 6, wherein as a dimming device (13), a FET switch (14) is disposed between the light emitting diode arrangement (11) or the smoothing capacitor (10) and ground and gate inputs of the FET switches (14) are jointly connected to a dimming control signal (15).

8. A control circuit according to claim 1, wherein the light emitting diode arrangements (11) each have a light emitting diode string (16) each including at least two light emitting diodes.

9. A control circuit according to claim 6, wherein as a balancing device, the control circuit (1) has a transformer arrangement that has a balancing transformer (8) for each of the circuit branches, and primary windings (12) of the circuit branches (6) are connected in series and secondary windings (7) are connected to the rectifiers (9).

10. A control circuit according to claim 9, wherein the primary windings (12) of the balancing transformers (8) are connected to an AC voltage output of an inverter circuit (3).

* * * * *